US010290985B1

(12) United States Patent
Mao

(10) Patent No.: US 10,290,985 B1
(45) Date of Patent: May 14, 2019

(54) INVERTED POWER STRIP

(71) Applicant: Shenzhen HUYUAN Electric Technology Co., Ltd., Shenzhen, Guangdong (CN)

(72) Inventor: Xiangyang Mao, Guangdong (CN)

(73) Assignee: Shenzhen HUYUAN Electric Technology Co., Ltd., Shenzhen (CN)

( * ) Notice: Subject to any disclaimer, the term of this patent is extended or adjusted under 35 U.S.C. 154(b) by 0 days.

(21) Appl. No.: 15/943,746

(22) Filed: Apr. 3, 2018

Related U.S. Application Data

(63) Continuation of application No. PCT/CN2018/079201, filed on Mar. 15, 2018.

(51) Int. Cl.

| | |
|---|---|
| ***H01R 25/00*** | (2006.01) |
| ***H01R 13/514*** | (2006.01) |
| ***H01R 13/629*** | (2006.01) |
| ***H01R 13/52*** | (2006.01) |
| ***H01R 13/66*** | (2006.01) |
| *H01R 24/28* | (2011.01) |
| *H01R 103/00* | (2006.01) |

(52) U.S. Cl.
CPC ..... *H01R 25/003* (2013.01); *H01R 13/514* (2013.01); *H01R 13/5213* (2013.01); *H01R 13/629* (2013.01); *H01R 13/66* (2013.01); *H01R 24/28* (2013.01); *H01R 25/006* (2013.01); *H01R 2103/00* (2013.01)

(58) Field of Classification Search
CPC ..... H01R 25/003; H01R 13/514; H01R 13/5213; H01R 13/629; H01R 13/66; H01R 24/28; H01R 2105/00
USPC ..... 439/651
See application file for complete search history.

(56) References Cited

U.S. PATENT DOCUMENTS

| | | | | |
|---|---|---|---|---|
| 4,367,417 | A * | 1/1983 | Casasanta | F21V 23/06 174/491 |
| 4,740,167 | A * | 4/1988 | Millhimes | H01R 31/00 439/170 |
| 6,015,307 | A * | 1/2000 | Chiu | H01R 13/71 200/51.09 |
| 7,112,097 | B1 * | 9/2006 | Lam | H01R 25/003 439/654 |
| 8,002,587 | B2 * | 8/2011 | Fleisig | H01R 13/6658 439/654 |
| 8,142,199 | B1 * | 3/2012 | Almouli | H01R 25/142 439/10 |
| 8,471,718 | B1 * | 6/2013 | Miller | G04C 23/04 307/131 |
| 2004/0106313 | A1 * | 6/2004 | Drane | H01R 13/447 439/142 |

(Continued)

*Primary Examiner* — Harshad C Patel

(57) ABSTRACT

The present invention relates to an inverted power strip comprising a housing, an base plate, and an extension cord. The housing comprises a top plate without jack defined thereon and a side wall. The base plate is arranged inside the housing opposing the top plate of the housing, and the base plate has a plurality of three-hole and/or two-hole power jacks arranged thereon. A ground copper plate, a neutral copper plate, and a live copper plate are arranged between the housing and the base plate, and the ground copper plate, the neutral copper plate, and the live copper plate are electrically isolated. The inverted power strip according to the present invention is safe, and aesthetically pleasant, and meets the requirements for automated assembly.

13 Claims, 10 Drawing Sheets

(56) References Cited

U.S. PATENT DOCUMENTS

| | | | | |
|---|---|---|---|---|
| 2006/0073731 | A1* | 4/2006 | Chien | F21S 8/035<br>439/536 |
| 2010/0261376 | A1* | 10/2010 | Hwang | H01R 13/60<br>439/501 |
| 2010/0277892 | A1* | 11/2010 | Konopelko | H01R 13/6658<br>362/95 |
| 2018/0149350 | A1* | 5/2018 | Johnson-Gray | H02J 7/355 |

* cited by examiner

INVERTED POWER STRIP

CROSS REFERENCE TO RELATED APPLICATIONS

The present application is a continuation application of PCT application No. PCT/CN2018/079201 filed on Mar. 15, 2018, the entire contents of which are incorporated herein by reference.

TECHNICAL FIELD

The present invention relates to the technical field of electrical power strips, and particularly to an inverted power strip.

BACKGROUND

Electrical power strip is currently the most widely known and widely used electrical product having relatively long history. Till now, jacks in all the power strip products available face upward.

It is well known that power strips with upward-facing jacks need to be prevented from dust deposition and wetted by water, is inconvenient for scrubbing during operation, and is unsafe, which includes the potential risk to the life safety of child populations, short circuit caused by rainwater drifting into the windows in the rainy summer days that wet existing power strips operating in the vicinity of the windows, and short circuit and other circumstances caused by water spatters onto the power strips arising from cleaning the floor or accidentally knocking over a cup during the daily life and work.

SUMMARY

In view of the above problems, the present invention provides an inverted power strip, which is safe, and aesthetically pleasant, and meets the requirements for automated assembly.

According to the present invention, an inverted power strip comprises a housing, an base plate, and an extension cord. The housing comprises a top plate without jack defined thereon and a side wall. The base plate is arranged inside the housing opposing the top plate of the housing, and the base plate has a plurality of three-hole and/or two-hole power jacks arranged thereon. A ground copper plate, a neutral copper plate, and a live copper plate are arranged between the housing and the base plate, and the ground copper plate, the neutral copper plate, and the live copper plate are electrically isolated.

Preferably, the extension cord is detachably mounted to the base plate, each end of the extension cord is provided with a plug.

Preferably, a plurality of openings is defined at a bottom of the sidewall of the housing to allow electric cords to pass through, and the opening extends along an axial direction of the housing and opens at the bottom of the housing.

Preferably, the opening is of arch shape, U shape or V shape.

Preferably, the opening is arranged corresponding to a respective one of the three-hole and/or two-hole power jacks.

Preferably, the base plate comprises an insulating wall, the ground copper plate comprises a plurality of ground terminals with slots, and the insulating wall comprises a plurality of insulating sheaths accommodating the ground terminals.

Preferably, the insulating wall further comprises an insulating plate, wherein the insulating plate extends in a bend pattern and is arranged alternately with the insulating sheath in an extension direction.

Preferably, the live copper plate, the ground copper plate and the neutral copper plate are all mounted on the base plate.

Preferably, each of the live copper plate and the neutral copper plate has a plurality of terminals, the base plate comprises a plurality of mounting seat, each of the mounting seats is configured for receiving a respective terminal of the live copper plate and a respective terminal of the neutral copper plate, and two terminals received in a same mounting seat are insulated from each other.

Preferably, the ground copper plate has a plurality of terminals, at least one of the plurality of mounting seats receives a respective terminal of the ground copper plate. 11. The inverted power strip according to claim 9, wherein at least one of the plurality of mounting seats is provided with a cap.

Preferably, the extension cord is non-detachably mounted on the base plate.

Preferably, the housing is closed at the top.

Preferably, the inverted power strip has a disc shape, and the plurality of three-hole and/or two-hole power jacks are arranged along a circumferential direction of the inverted power strip.

Preferably, a cylindrical bump is provided at a central position at one side of the base plate, and the three-hole power jacks and/or two-hole power jacks are disposed around the bump.

Preferably, the bump is provided with a jack to allow the extension cord to insert.

Preferably, the live copper plate, the ground copper plate, and the neutral copper plate are annular.

Preferably, the housing is substantially cylindrical.

Preferably, the housing has a flared sidewall.

Preferably, the inverted power strip is generally cuboidal, and the live copper plate, and/or the ground copper plate, and/or the neutral copper plate are elongated.

According to the inverted power strip provided in the present invention, by means of the downward-facing design of the jacks, the safety of the power strip is significantly improved, and the service life of the power strip is accordingly improved. The power strip also has elegant appearance. The design of the double ended extension cord and the copper plates facilitates the replacement of the extension cord of the power strip, and allows the inverted power strip of the present invention to be produced without the wire soldering process, so as to fully meet the requirement of fetching by a unmanned automatic robot during the assembly process.

DESCRIPTION OF THE EMBODIMENTS

Figure 1:
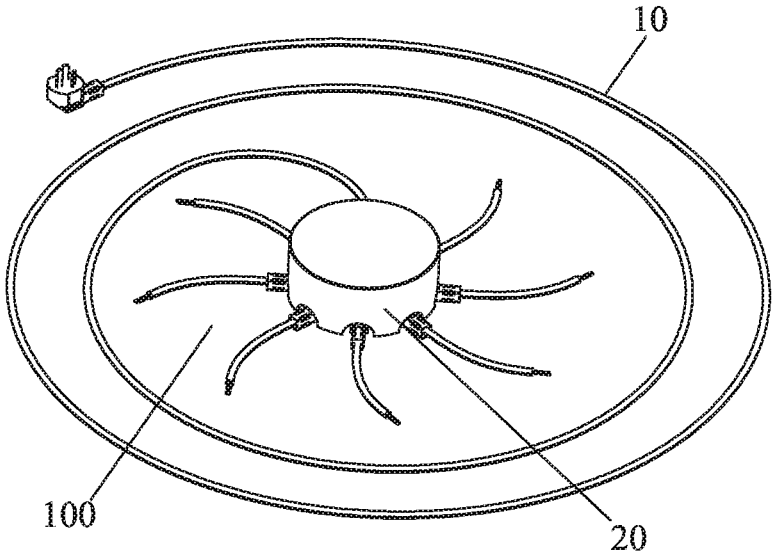
FIG. 1 is a schematic view of a first embodiment of an inverted power strip according to the present invention.

To make the objects, technical solutions, and advantages of the present invention clearer, the present invention is described in further detail with reference to accompanying drawings and examples. It should be understood that the specific examples described herein are merely provided for illustrating, instead of limiting the present invention.

FIGS. 1 to 4 show an inverted power strip 100 according to a first embodiment of the present invention. The inverted power strip 100 comprises a housing 20, an base plate 40, a live copper plate 60, a neutral copper plate 80, a ground copper plate 70, and an extension cord 10.

Figure 2:
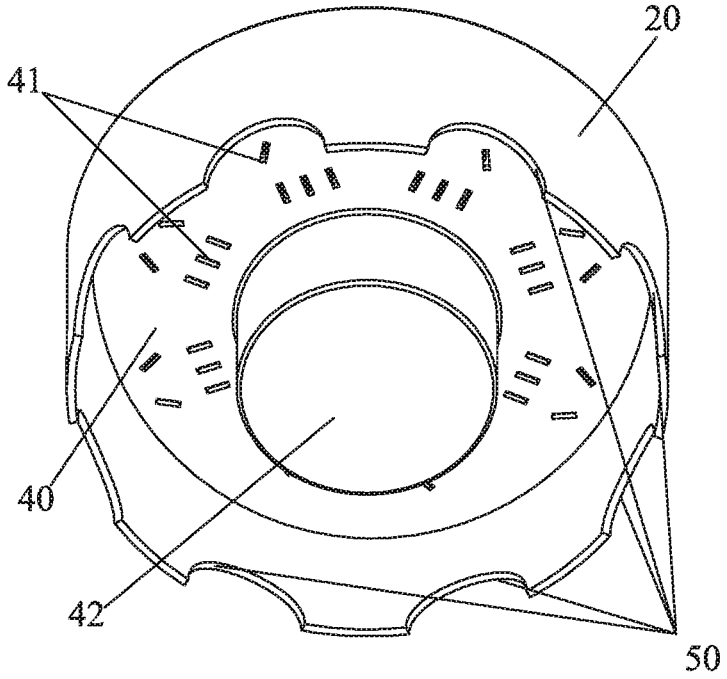
FIG. 2 is another schematic view of the inverted power strip shown in FIG. 1, in which the extension cord is omitted.

FIG. 2 shows another schematic view of the inverted power strip 100 shown in FIG. 1, in which the extension cord 10 is omitted. The housing 20 is substantially of a cylindrical shape with an opening at the bottom and includes a top plate and a side wall extending from the periphery of the top plate. Preferably, the side wall is circular. In this embodiment, the side wall is substantially perpendicular to the top plate. No jacks are arranged on the top plate of the housing 20, and the top plate is preferably a closed top plate. No jacks are arranged on the side wall of the housing 20 either, and a plurality of openings 50 is disposed at the bottom of the side wall for allowing the electric cords to pass through. In this embodiment, the opening 50 is of arch shape. The opening 50 extends along a longitudinal axis of the housing 20, and opens at the bottom of the housing 20.

The base plate 40, preferably formed by insulating material, such as plastic, is arranged inside the housing 20, and designed to have a circular shape having a diameter that is equal to or slightly greater than the inner diameter of the housing 20 in this embodiment. The base plate 40 is arranged opposing and preferably in parallel with the top of the housing 20. A plurality of three-hole and/or two-hole power jacks 41 is arranged on the base plate 40 circumferentially. Preferably, the power jacks 41 are arranged at positions corresponding to the positions at which the arch-shaped openings 50 are arranged, that is, each of the three-hole and/or two-hole power jacks 41 is radially lined up with one corresponding arch-shaped opening 50. Preferably, a cylindrical bump 42 is arranged at a central position on a lower surface of the base plate 40. The bump 42 extends along a longitudinal axis of the housing 20 towards the bottom of the housing 20, until reaching the bottom level of the housing 20. In this embodiment, the bump 42 is recessed downward from the center of the base plate 40, and an end of the bump 42 away from the base plate 40 is closed. The formation of the bump allows a recess to be formed on the upper surface of the base plate 40. The power jacks 41 are preferably evenly arranged around the bump.

Figure 3:
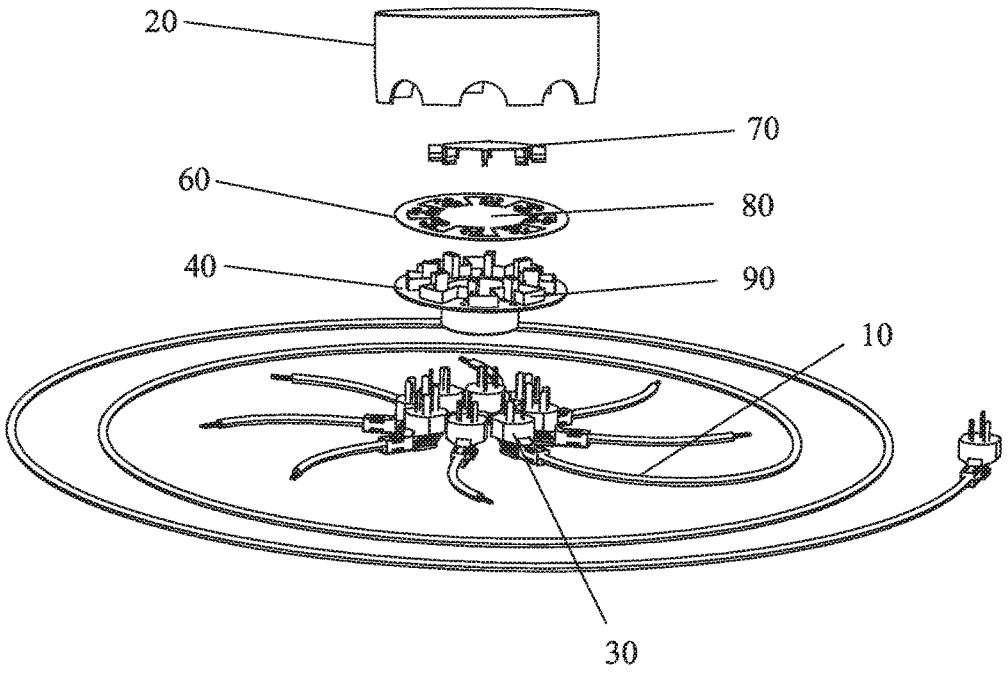
FIG. 3 is an exploded view of the inverted power strip shown in FIG. 1.

FIG. 3 shows an exploded view of the inverted power strip shown in FIG. 1. Unlike the traditional power strip, the extension cord in the inverted power strip according to the present invention is a double ended extension cord, that is, a second plug 30 is additionally provided on the basis of a conventional extension cord. That is to say, in the inverted power strip according to the present invention, the extension cord is adapted to be detachably mounted or inserted or fitted to the power strip body, such that extension cords of different lengths can be replaced conveniently as desired in practice, with no need to additionally purchase a new power strip due to the insufficient or excess length of the extension cord.

Figure 4:
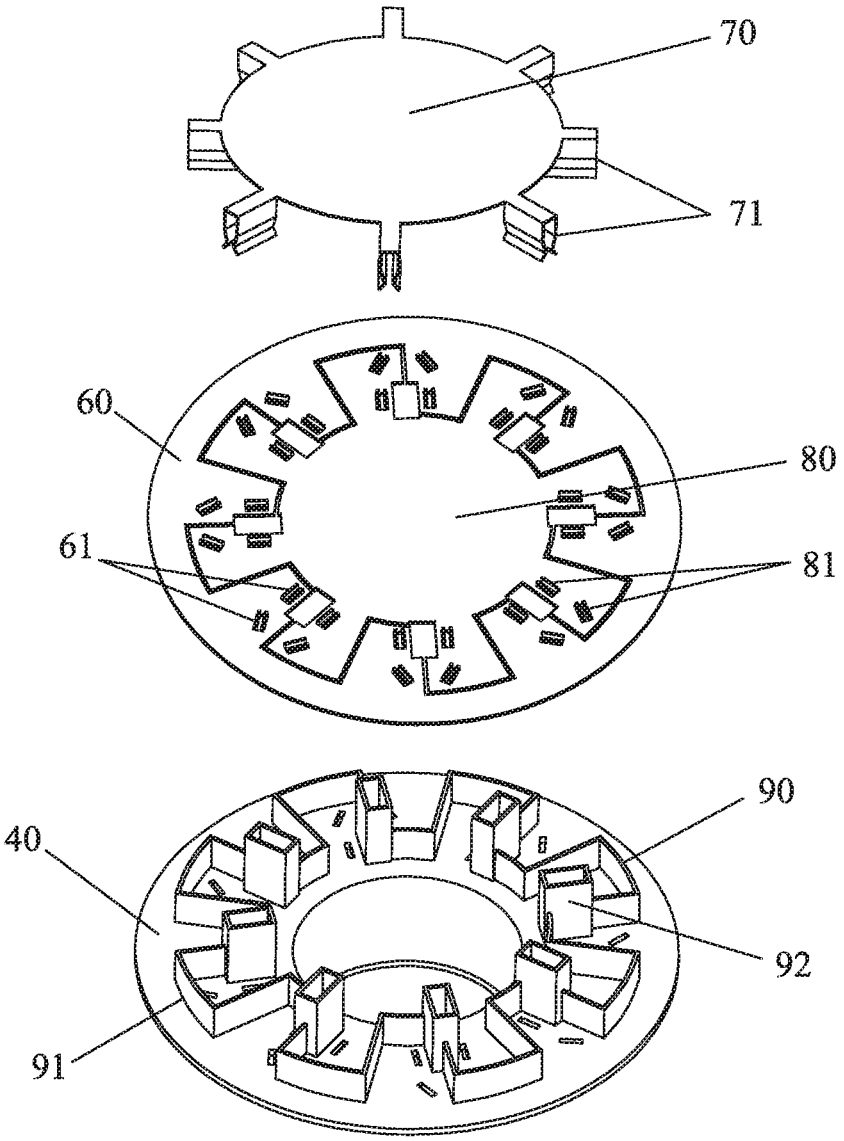
FIG. 4 is a detail view of the inverted power strip shown in FIG. 3, with some elements removed.
Figure 5:
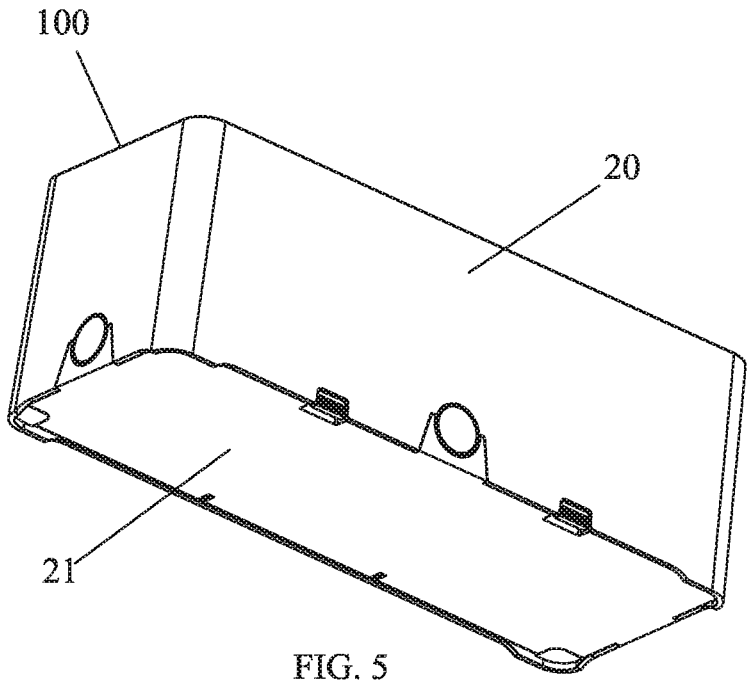
FIG. 5 is a schematic view of a second embodiment of an inverted power strip according to the present invention.
Figure 6:
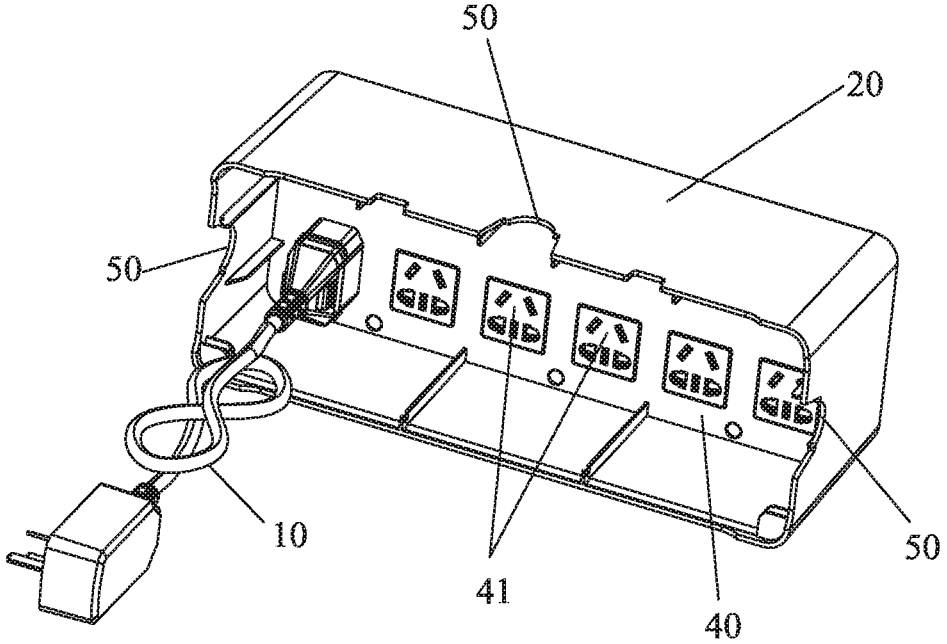
FIG. 6 is another schematic view of the inverted power strip shown in FIG. 5, in which a bottom cover is omitted.
Figure 7:
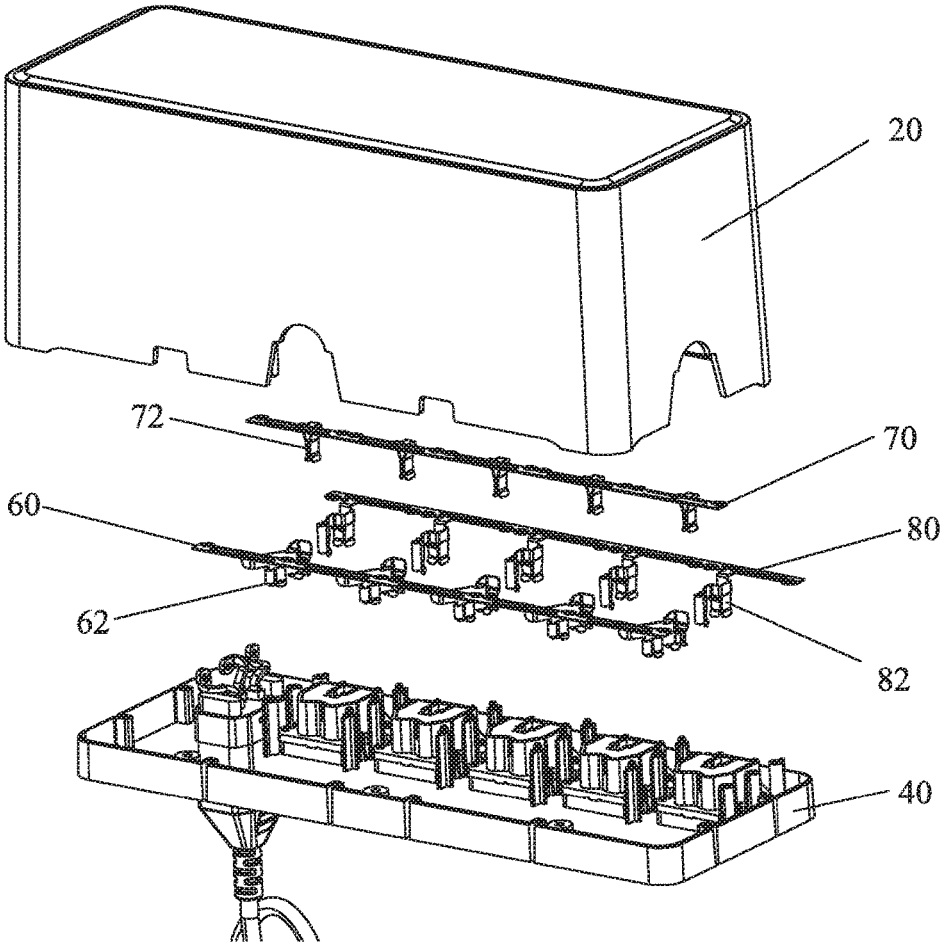
FIG. 7 is an exploded view of the inverted power strip shown in FIG. 6.
Figure 8:
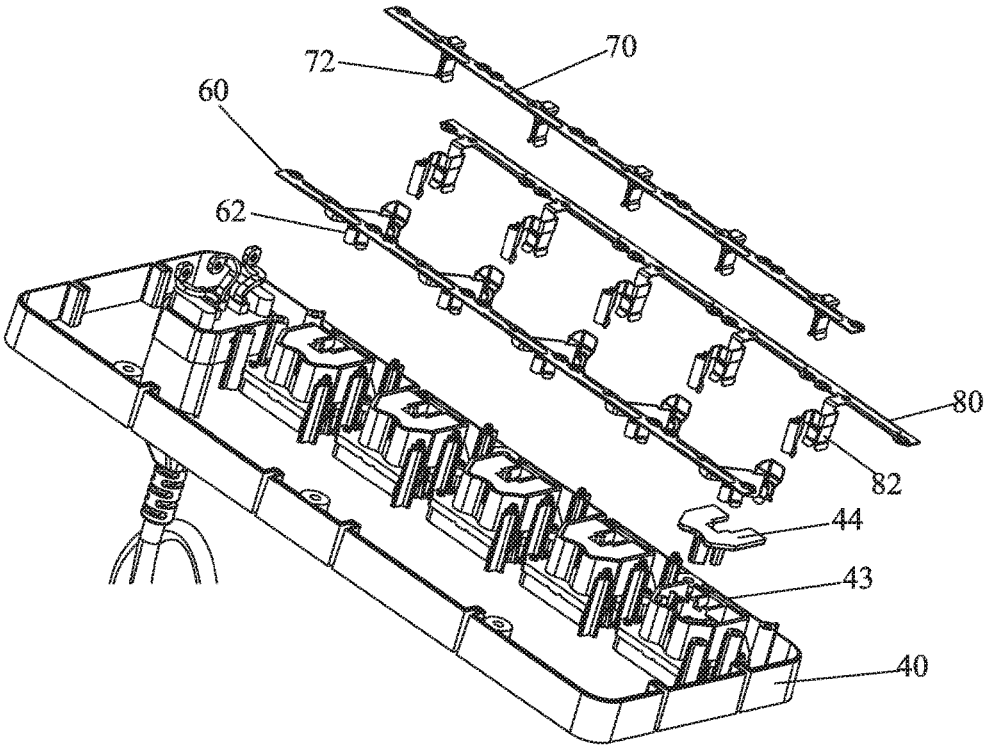
FIG. 8 is a detail view of the inverted power strip shown in FIG. 7, with a portion of elements removed.
Figure 9:
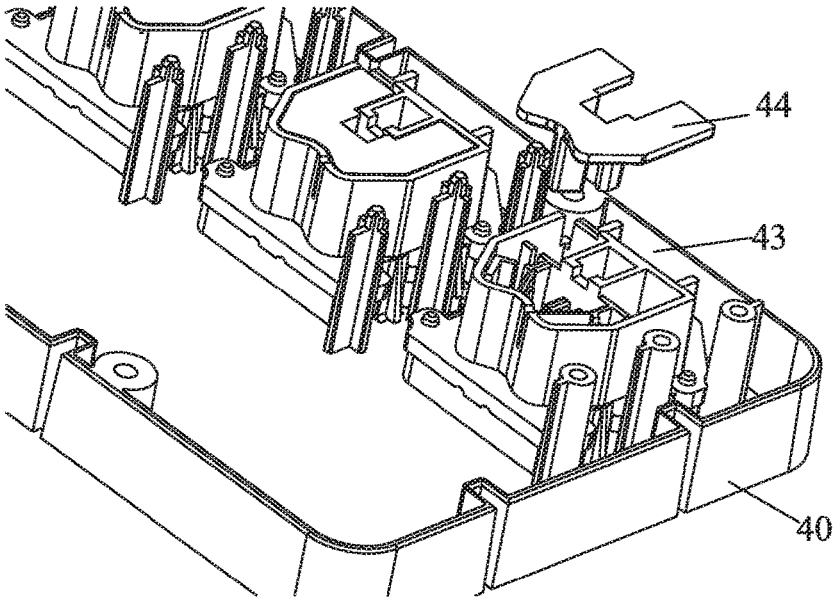
FIG. 9 is a enlarged view of a portion of the inverted power strip shown in FIG. 8.
Figure 10:
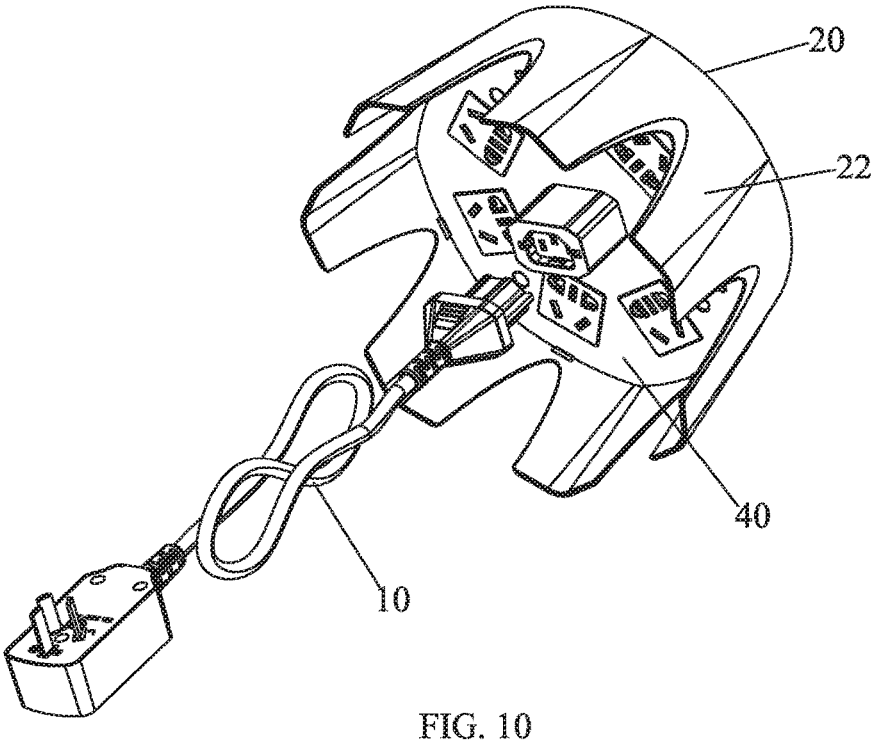
FIG. 10 is a schematic view of a third embodiment of an inverted power strip according to the present invention.

In this embodiment, the base plate 40 includes an insulating wall 90, which is arranged on or integrally formed with the base plate 40, between the housing 20 and the base plate 40, as detailed in FIG. 4.

The ground copper plate 70, the neutral copper plate 80, and the live copper plate 60 are further arranged between the housing 20 and the base plate 40, as detailed in FIG. 4. The insulating wall 90 is formed by insulating material, and configured to electrically isolate the ground copper plate 70, the neutral copper plate 80, and the live copper plate 60. Preferably, the neutral copper plate 80 and the live copper plate 60 may be arranged on the same plane, parallelly below the ground copper plate 70.

A plurality of ground terminals with slots 71 mating with ground pins of plugs are arranged on the ground copper plate 70, such that the ground copper plate 70 can be electrically connected to the ground wires of the plug. The ground slots 71 are all arranged to be electrically connected. In this embodiment, the ground copper plate 70 has a circular body portion, and the plurality of ground slots 71 is circumferentially connected to the body portion, and preferably evenly distributed along the circumference.

A plurality of live jacks 61 mating with live pins of plugs are arranged on the live copper plate 60, such that the live copper plate 60 can be electrically connected to the live wires of the plug. The live jacks 61 are all arranged to be electrically connected.

A plurality of neutral jacks 81 mating with neutral pins of plugs are arranged on the neutral copper plate 80, such that the neutral copper plate 80 can be electrically connected to the neutral wires of the plug. The neutral jacks 81 are all arranged to be electrically connected. Each of the live jacks corresponding to one of the neutral jacks.

The ground slots 71, the live jacks 61, and the neutral jacks 81 are lined with the three-hole power jacks and/or two-hole power jacks 41 on the base plate 40.

The insulating wall 90 is configured to electrically isolate the ground slots 71, the live jacks 61, and the neutral jacks 81. The insulating wall 90 extends circularly around the recess on the base plate 40, in the form of square waves, and preferably closed square waves. In other words, if the insulating wall 90 is circularly deployed, it extends substantially in the form of square waves. The insulating wall 90 comprises a substantially bent plate-shaped or sheet-shaped insulating plate 91 and a hollow cylindrical insulating sheath 92. The insulating plate 91 and the insulating sheath 92 are disposed alternately along the direction of extension of the insulating wall 90.

The neutral copper plate 80 is located radially at the inner side of the insulating wall 90, that is, in a space enclosed by the insulating wall 90. The live copper plate 60 is located radially at the outer side of the insulating wall 90, and electrically isolated from the neutral copper plate 80 by the insulating wall 90. The insulating sheath 92 is configured to receive a respective ground terminal. Preferably, the insulating sheath 92 is elevated from the upper surface of the base plate 40 by a height that is greater than the height of the insulating plate 91, whereby the ground copper plate 70 is located above and ensured to be electrically isolated from the live copper plate 60 and the neutral copper plate 80.

FIGS. 5 to 9 show a second embodiment of the inverted power strip according to the present invention, in which the same or similar components as in the first embodiment are denoted by the same reference numerals. This embodiment is basically similar to the first embodiment, and thus the similar parts between them are not described herein again. It should be noted that unlike the first embodiment, the housing 20 is cuboidal and is open at its bottom which is covered by a bottom cover 21. The housing 20 has at least one opening 50 on the side surfaces. In this embodiment, three openings 50 are provided, respectively, on three side surfaces of the housing 20.

In this embodiment, the base plate 40 is correspondingly designed to be rectangular and has a side length that is equal to or slightly greater than the side length at the bottom of the housing 20. In contrast, the insulating wall presented in the first embodiment is omitted in this embodiment. The ground copper plate 70, the neutral copper plate 80, and the live copper plate 60 are substantially elongated with respective terminals 62, 72, 82 formed thereon. The ground copper plate 70, the neutral copper plate 80, and the live copper plate 60 are all mounted on the base plate 40 in such a manner that they are electrically insulated from each other by the base plate 40. Preferably, the base plate 40 has a plurality of mounting seat 43 with a three-hole and/or a two-hole power jack formed thereon for receiving a respective terminal 62 of the live copper plate 60, a respective terminal 82 of the neutral copper plate 80, and optionally a respective terminal 72 of the ground copper plate 70.

Preferably, each mounting seat 43 is provided with a cap 44 for further separating and insulating the terminals 62, 72, 82. The cap 44 is fixed to the top of the mounting seat 43 after the copper plates 60, 70, 80 have been assembled.

FIGS. 10 to 15 show a third embodiment of the inverted power strip according to the present invention, in which the same or similar components as in the first embodiment are denoted by the same reference numerals. This embodiment is basically similar to the first embodiment, and thus the similar parts between them are not described herein again.

Figure 11:
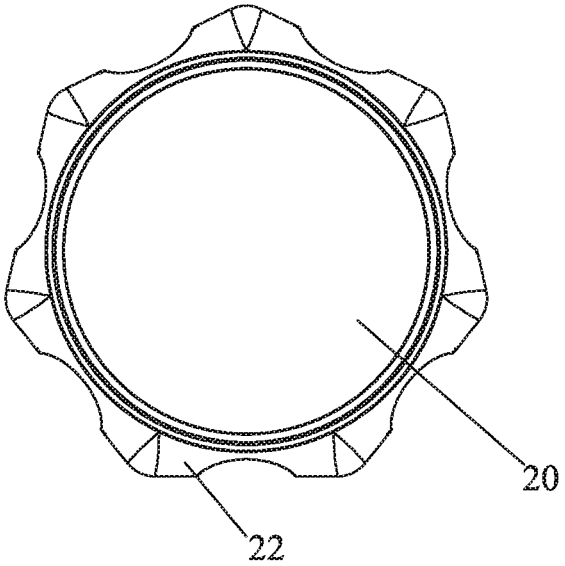
FIG. 11 is a top view of the inverted power strip shown in FIG. 10.
Figure 12:
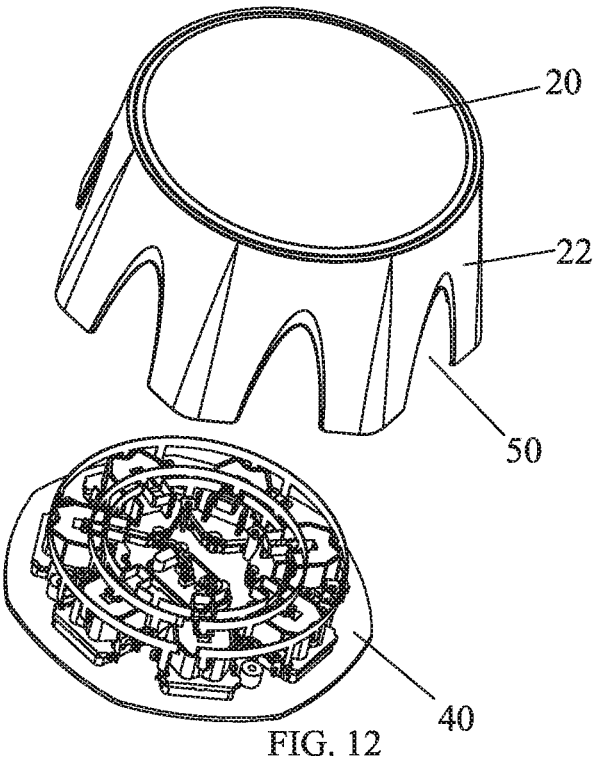
FIG. 12 is an exploded view of the inverted power strip shown in FIG. 11.
Figure 13:
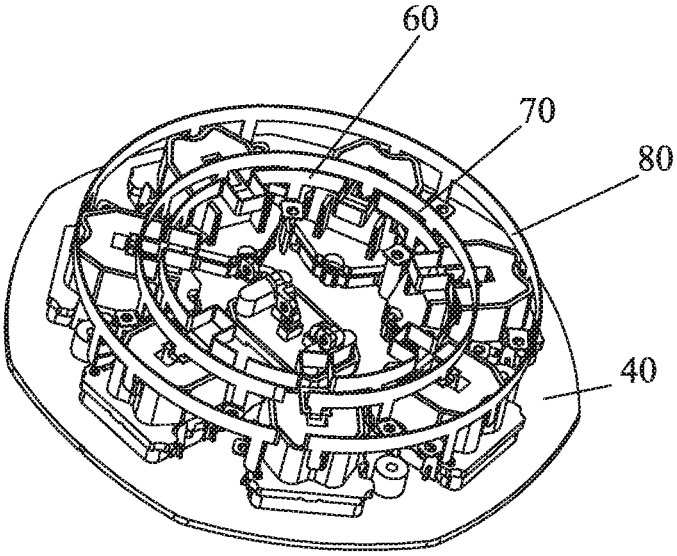
FIG. 13 is a detail view of the inverted power strip shown in FIG. 12, with a housing thereof removed.
Figure 14:
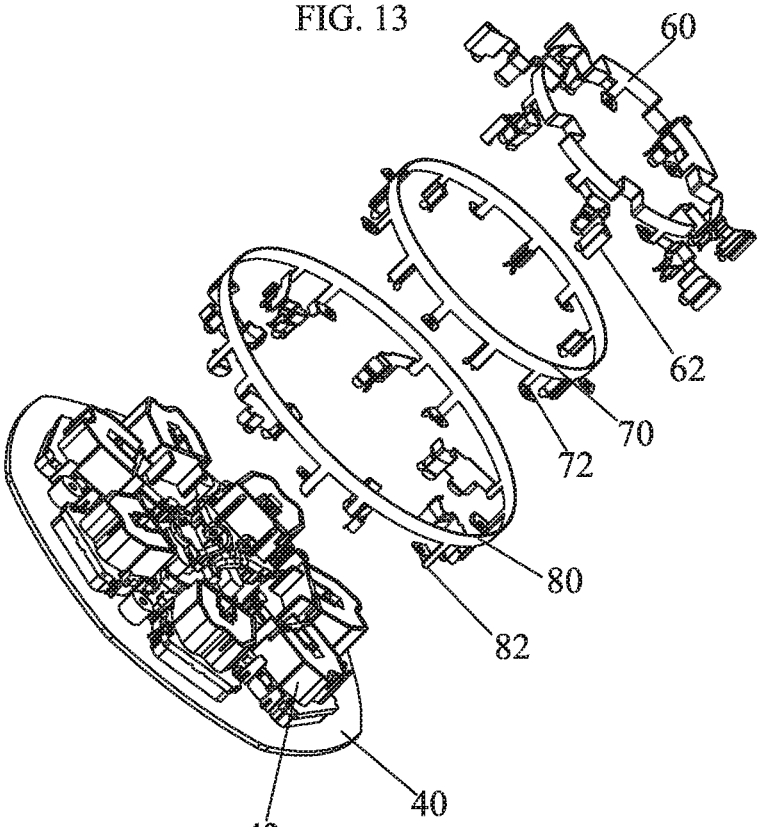
FIG. 14 is an exploded view of the inverted power strip shown in FIG. 13.
Figure 15:
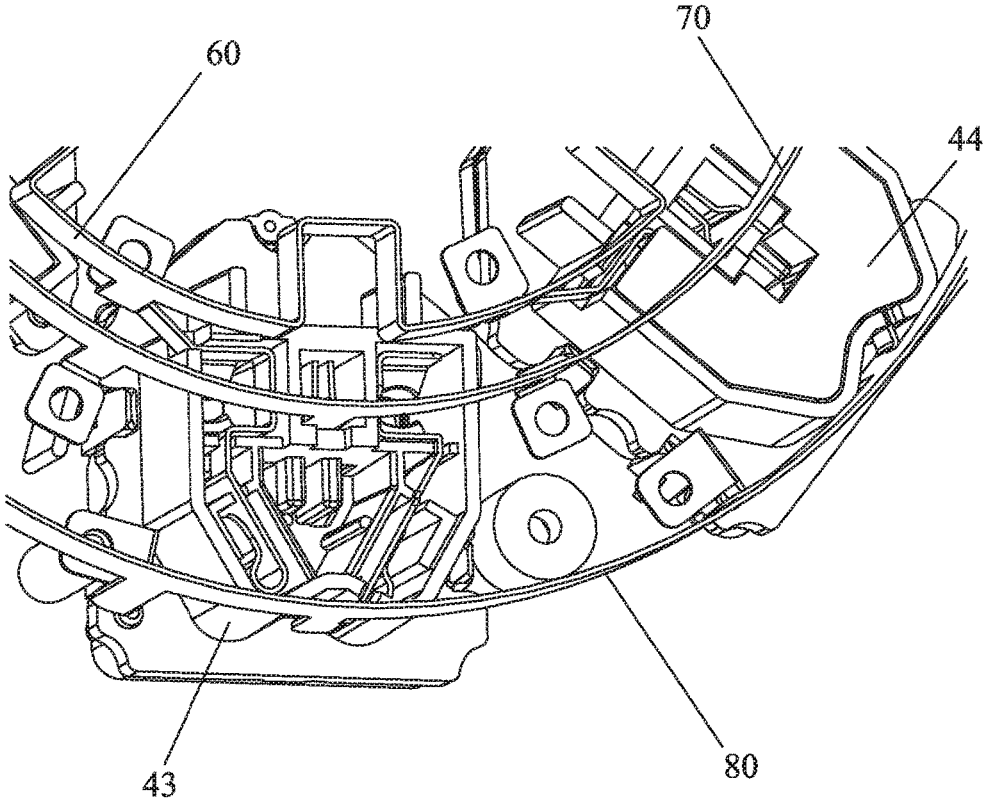
FIG. 15 is an enlarged view of a portion of the inverted power strip shown in FIG. 13, with a cap removed for clarity.

This embodiment differs from the first embodiment in that, the housing 20 has a flared sidewall 22, which is best shown in FIG. 11 and FIG. 12, rather than a cylindrical and straight sidewall as presented in the first embodiment. In addition, the shape of the openings 50 is substantially V shaped or U shaped, rather than arch shaped as presented in the first embodiment. Further, the extension cord 10 is detachably insertable into a specialized jack which is located at a central portion of the base plate 40. The three-hole and/or two-hole power jacks are circumferentially arranged around the specialized jack.

Similar to the second embodiment, the insulating wall presented in the first embodiment is also omitted in this embodiment. The ground copper plate 70, the neutral copper plate 80, and the live copper plate 60 in this embodiment are designed to be substantially annular with respective terminals 62, 72, 82 formed thereon. The ground copper plate 70, the neutral copper plate 80, and the live copper plate 60 are all mounted on the base plate 40 in such a manner that they are electrically insulated from each other by the base plate 40. Preferably, the base plate 40 has a plurality of mounting seat 43 with a three-hole and/or two-hole power jack formed thereon for receiving a respective terminal 62 of the live copper plate 60, a respective terminal 72 of the ground copper plate 70 and a respective terminal 82 of the neutral copper plate 80. Preferably, each mounting seat 43 is provided with a cap 44 for further separating and insulating the terminals 62, 72, 82.

According to the inverted power strip provided in the present invention, by means of the downward-facing design of the jacks, the safety of the power strip is significantly improved, and the service life of the power strip is accordingly improved. The power strip also has elegant appearance. The designs of the double ended extension cord and the copper plates in some embodiments facilitate the replacement of the extension cord of the power strip, and allows the inverted power strip of the present invention to be produced without the wire soldering process, so as to fully meet the requirement of fetching by a unmanned automatic robot during the assembly process. However, it should be understood that the extension cord can be undetachably connected to the base plate in other embodiments, for example, by welding or the like.

The present invention has been described in detail with reference to preferred embodiments, which however are not intended to limit the present invention. Any modifications and equivalent improvements and substitutions can be made thereto without departing from the spirit and principle of the present invention, which are all fall within the protection scope of the present invention.

What is claimed is:

1. An inverted power strip comprising:

a housing having an opening at a bottom, the housing comprising a top plate without jack defined thereon and a sidewall;

an base plate arranged inside the housing opposing the top plate of the housing, the base plate having a plurality of three-hole and/or two-hole power jacks arranged thereon; and an extension cord, wherein a ground copper plate, a neutral copper plate, and a live copper plate are provided between the housing and the base plate, and the ground copper plate, the neutral copper plate, and the live copper plate are electrically isolated from each other;

wherein the live copper plate, the ground copper plate and the neutral copper plate are all mounted on the base plate;

wherein each of the live copper plate and the neutral copper plate has a plurality of terminals, the base plate comprises a plurality of mounting seat, each of the mounting seats is configured for receiving a respective terminal of the live copper plate and a respective terminal of the neutral copper plate, and two terminals received in a same mounting seat are insulated from each other; and wherein at least one of the plurality of mounting seats is provided with a cap.

2. The inverted power strip according to claim 1, wherein the extension cord is detachably mounted to the base plate, each end of the extension cord is provided with a plug.

3. The inverted power strip according to claim 1, wherein a plurality of openings is defined at a bottom of the sidewall of the housing to allow electric cords to pass through, and the opening extends along an axial direction of the housing and opens at the bottom of the housing.

4. The inverted power strip according to claim 3, wherein the opening is of arch shape, U shape or V shape.

5. The inverted power strip according to claim 3, wherein the opening is arranged corresponding to a respective one of the three-hole and/or two-hole power jacks.

6. The inverted power strip according to claim 1, wherein the ground copper plate has a plurality of terminals, at least one of the plurality of mounting seats receives a respective terminal of the ground copper plate.

7. The inverted power strip according to claim 1, wherein the extension cord is non-detachably mounted on the base plate.

8. The inverted power strip according to claim 1, wherein the housing is closed at the top.

9. The inverted power strip according to claim 1, wherein the inverted power strip is generally cuboidal, and the live copper plate, and/or the ground copper plate, and/or the neutral copper plate are elongated.

10. An inverted power strip comprising:

a housing having an opening at a bottom, the housing comprising a top plate without jack defined thereon and a sidewall;

an base plate arranged inside the housing opposing the top plate of the housing, the base plate having a plurality of three-hole and/or two-hole power jacks arranged thereon; and an extension cord, wherein a ground copper plate, a neutral copper plate, and a live copper plate are provided between the housing and the base plate, and the ground copper plate, the neutral copper plate, and the live copper plate are electrically isolated from each other;

wherein the inverted power strip has a disc shape, and the plurality of three-hole and/or two-hole power jacks are arranged along a circumferential direction of the inverted power strip;

wherein a cylindrical bump is provided at a central position at one side of the base plate, and the three-hole power jacks and/or two-hole power jacks are disposed around the bump; and wherein the bump is provided with a jack to allow the extension cord to insert.

11. The inverted power strip according to claim 10, wherein the live copper plate, the ground copper plate, and the neutral copper plate are annular.

12. The inverted power strip according to claim 10, wherein the housing is substantially cylindrical.

13. The inverted power strip according to claim 10, wherein the housing has a flared sidewall.

* * * * *